US006726434B2

(12) United States Patent
Orthaus et al.

(10) Patent No.: US 6,726,434 B2
(45) Date of Patent: Apr. 27, 2004

(54) TRAFFIC CONE SETTING DEVICES FOR DEPOSITING TRAFFIC CONES ONTO ROADWAY SURFACES

(75) Inventors: Chad Orthaus, Alexandria, MN (US); Merwin Anderson, Glenwood, MN (US); Jamie Zimmerman, Miltona, MN (US); Bertrum England, Farwell, MN (US); Brad Anderson, Alexandria, MN (US); Jeffrey Arnold Wilkens, Reiles Acres, ND (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/247,834

(22) Filed: Sep. 20, 2002

(65) Prior Publication Data

US 2004/0057822 A1 Mar. 25, 2004

(51) Int. Cl.[7] ..... E01F 09/01
(52) U.S. Cl. ..... 414/539; 414/551; 414/435
(58) Field of Search ..... 414/539, 551, 414/435; 221/185, 221, 222

(56) References Cited

U.S. PATENT DOCUMENTS

| | | | | |
|---|---|---|---|---|
| 3,750,900 A | * | 8/1973 | Piercey | 414/788.2 |
| 5,054,648 A | | 10/1991 | Luoma | |
| 5,213,464 A | | 5/1993 | Nicholson et al. | |
| 5,244,334 A | * | 9/1993 | Akita et al. | 414/502 |
| 5,525,021 A | * | 6/1996 | Larguier | 414/551 |
| 6,056,498 A | * | 5/2000 | Velinsky et al. | 414/555 |
| 6,435,369 B1 | * | 8/2002 | Poursayadi | 221/185 |

* cited by examiner

*Primary Examiner*—Khoi H. Tran
(74) *Attorney, Agent, or Firm*—Schwartz & Weinrieb

(57) ABSTRACT

Apparatus for depositing or placing traffic cones onto a roadway surface at predeterminedly spaced locations thereof comprises a horizontally disposed magazine, and a vertically oriented chute section. A plurality of traffic cones can be loaded into the magazine section, and a leading one of the traffic cones can be moved into the vertically oriented chute section for discharge and deposition onto the roadway surface. An automatic control system can also be used to control the discharge of the traffic cones into the vertically oriented chute section in accordance with predeterminedly timed sequences such that the traffic cones can be placed upon the roadway surface at locations which are spaced apart by predeterminedly defined distances.

26 Claims, 8 Drawing Sheets

TRAFFIC CONE SETTING DEVICES FOR DEPOSITING TRAFFIC CONES ONTO ROADWAY SURFACES

FIELD OF THE INVENTION

The present invention relates generally to the deposition of traffic cones onto roadway surfaces, and more particularly to new and improved traffic cone setting devices, mechanisms, or apparatus for both semi-automatically and automatically depositing traffic cones at predeterminedly spaced locations of roadway surfaces in accordance with predeterminedly timed sequences.

BACKGROUND OF THE INVENTION

Traffic cones are a ubiquitous sight upon the nation's roadways whether they are being used, for example, to visually indicate to motorists either the presence of a construction site, to delineate and separate moving lanes of traffic from roadside work zones, to close particular street regions to oncoming traffic, or the like. As is well known, a supply of traffic cones is usually carried upon a roadwork truck or vehicle operated either by means of a local government agency or a subcontractor organization hired by the local government, and as is often the case, the traffic cones are manually deposited or placed upon the particular roadway by means of operators or workmen personnel who take individual traffic cones from a supply of such cones carried upon the roadwork truck or vehicle and place the individual traffic cones upon the roadway surface at predeterminedly spaced intervals along the particular route being travelled by the roadwork truck or vehicle. In accordance with one mode of operation, the operators or workmen personnel may be positioned upon one side of the roadwork truck or vehicle, and while effectively hanging onto, for example, a rail member, or similar support, of the roadwork truck or vehicle by means of one arm, the operator or workman places a traffic cone onto the roadway with his or her other arm. Alternatively, an individual operator or workman will often sit upon a rear bed, deck, or platform portion of the roadwork vehicle or truck so as to be capable of periodically depositing the traffic cones along the roadway as the roadwork vehicle or truck moves along the particular route along which the traffic cones are to be deposited.

As can readily be appreciated, the aforenoted well-known modes of operation present significant safety problems for the operators or workmen personnel in that the operators or workmen personnel are disposed in precarious positions or orientations upon the roadwork truck or vehicle. Incidents have in fact occurred, for example, during such traffic cone placement or deposition operations, wherein workmen or operator personnel have accidentally fallen from the trucks or vehicles and have either suffered serious injuries, or even worse, have suffered injuries which have proven to be fatal. These situations are not of course entirely unanticipated in view of the fact that sometimes unexpected events occur during movement of the roadwork truck or vehicle alongside ongoing traffic. These events may cause, for example, the particular roadwork truck or vehicle to undergo somewhat sudden movements comprising a change in direction, necessary braking or acceleration, or the like. In addition, it is sometimes difficult for the workmen personnel or operators to simultaneously pick up and then properly control the disposition and placement of the traffic cones onto the roadway surface in view of the fact that each traffic cone weighs at least ten pounds depending upon the particular cone and its size. All of such movements, and the weight force inherent to each traffic cone, can cause destabilizing forces to effectively be impressed upon or transmitted to the operators or workmen personnel which can of course lead to the aforenoted unfortunate injury or death situations to occur as a result of an operator or workman either losing his or her balance, or losing his or her hand-held grip upon the truck or vehicle support structure. Still further, the constant lifting and manipulation of the traffic cones is not ergonomically desirable from a health point of view for the operators or workmen personnel.

In order to overcome such operational drawbacks characteristic of manual procedures for depositing traffic cones onto roadway surfaces, several automated systems have been proposed such as those systems disclosed, for example, within U.S. Pat. No. 5,244,334 which issued to Akita et al. on Sep. 14, 1993, U.S. Pat. No. 5,213,464 which issued to Nicholson et al. on May 25, 1993, or U.S. Pat. No. 5,054,648 which issued-to Luoma on Oct. 8, 1991. While all of such disclosed systems comprise systems for depositing traffic cones onto roadway surfaces, none of the systems disclose a magazine structure for enabling an operator to load a plurality of traffic cones into the system or means for automatically dispensing the traffic cones so as to place the cones at predeterminedly spaced locations upon the roadway surfaces.

A need therefore exists in the art for a new and improved system or apparatus for depositing traffic cones onto roadway surfaces wherein as a result of the provision of such a system or apparatus, the operators or workmen personnel are not exposed to the dangers of oncoming traffic, and wherein further, the traffic cones can be readily, easily, and efficiently deposited without adversely affecting the workmen or operator personnel from an ergonomically healthful and non-fatiguing point of view.

OBJECTS OF THE INVENTION

Accordingly, it is an object of the present invention to provide new and improved devices, mechanisms, systems, or apparatus for depositing or placing traffic cones onto roadway surfaces.

Another object of the present invention is to provide new and improved devices, mechanisms, systems, or apparatus for depositing or placing traffic cones onto roadway surfaces wherein the operationally unsafe conditions characteristic of conventional manual traffic cone deposition or placement techniques or procedures can be effectively overcome.

An additional object of the present invention is to provide new and improved devices, mechanisms, systems, or apparatus for depositing or placing traffic cones onto roadway surfaces which comprise manual and semi-automatic devices, mechanisms, systems, or apparatus.

A further object of the present invention is to provide new and improved devices, mechanisms, systems, or apparatus for depositing or placing traffic cones onto roadway surfaces which comprise manual and semi-automatic devices, mechanisms, systems, or apparatus which enable operators or workmen personnel to be positioned at a location or work station which is substantially safe in that the location or work station is positioned relatively remote from the sides or rear end section of the roadwork truck or vehicle such that operators or workmen personnel will not or cannot readily fall off the roadwork truck or vehicle and onto the roadway even if the roadwork truck or vehicle undergoes or experiences relatively sudden movements.

A last object of the present invention is to provide new and improved devices, mechanisms, systems, or apparatus for depositing or placing traffic cones onto roadway surfaces which comprise manual and semi-automatic devices, mechanisms, systems, or apparatus which enable operators or workmen personnel to be positioned at a location or work station which is substantially safe in that the location or work station is positioned relatively remote from the sides or rear end section of the roadwork truck or vehicle such that operators or workmen personnel will not or cannot readily fall off the roadwork truck or vehicle and onto the roadway even if the roadwork truck or vehicle undergoes or experiences relatively sudden movements, and yet the individual operators or workmen can obviously control the deposition or placement of the traffic cones onto the roadway surfaces at predetermined locations and in accordance with desired timed sequence parameters or techniques.

SUMMARY OF THE INVENTION

The foregoing and other objectives are achieved in accordance with the teachings and principles of the present invention through the provision of a first embodiment of a new and improved device, mechanism, system, or apparatus, for depositing or placing traffic cones onto roadway surfaces at predeterminedly spaced locations thereof and in accordance with predeterminedly timed sequence techniques or parameters, which comprises a vertically oriented chute structure which is adjustably supported upon one side of the roadwork truck or vehicle. The vertically oriented chute structure has an arcuate configuration which subtends a 90° angular extent such that an upstream portion thereof is oriented so as to extend vertically while a downstream portion thereof is oriented so as to extend horizontally. The chute structure is also integrally connected to a horizontally oriented magazine structure which is fixedly secured to a rear wall member or support of the roadwork truck or vehicle and which is adapted to house a plurality of traffic cones which can be manually placed or loaded therein by means of operator or workmen personnel. The traffic cones are disposed horizontally within the magazine structure, that is, the axes of the traffic cones, around which the three-dimensional structure of each traffic cone is defined, are oriented or extend horizontally, and accordingly, when a leading one of the traffic cones is manually moved from the horizontally oriented magazine structure into the vertically oriented chute structure, the traffic cone is initially disposed in a horizontal disposition or orientation at the upstream end portion of the chute structure. However, in view of the aforenoted arcuate configuration of the chute structure subtending its 90° arcuate extent, as the traffic cone slides downwardly within the chute structure under the influence of gravity, its disposition, as defined by its axis, will effectively be converted from a horizontal orientation to a vertical orientation whereupon automatic release or discharge from the downstream end portion of the chute structure, the traffic cone will be automatically deposited onto the roadway in its desired stand-up vertical orientation with its base portion supporting the same upon the roadway.

In accordance with a second embodiment of a new and improved device, mechanism, system, or apparatus, for depositing or placing traffic cones onto roadway surfaces at predeterminedly spaced locations thereof and in accordance with predeterminedly desired timed sequence techniques or parameters, there is likewise provided the aforenoted horizontally oriented traffic cone magazine structure and vertically oriented chute structure, however, in lieu of the device, mechanism, system, or apparatus of the second embodiment of the present invention being manually operated and controlled as has been noted hereinabove in accordance with the brief summary of the first embodiment of the present invention, the second embodiment of the present invention has incorporated therein a pair of alternatively or oppositely actuated pneumatic control means for automatically retaining and releasing the traffic cones at and from first upper READY and second lower DISCHARGE positions which are effectively located at the junction of the magazine section and the upper end portion of the vertically oriented chute. When the first upper pneumatic control means is extended so as to be capable of retaining a traffic cone at the upper READY position when a traffic cone is subsequently manually moved into the upper READY position, the second lower pneumatic control means is retracted so as to release a traffic cone, previously disposed at the lower DISCHARGE position, into the vertically oriented delivery chute. When the first upper pneumatic control means is subsequently retracted, while the second lower pneumatic control means is extended, a traffic cone, previously disposed at the upper READY position, is now released and moved to the lower DISCHARGE position, and is retained at such position by means of the extended second lower pneumatic control means. The operational cycle is then repeated so as to serially dispense or discharge a plurality of traffic cones into the vertically oriented delivery chute for deposition upon the roadway surface.

BRIEF DESCRIPTION OF THE DRAWINGS

Various other objects, features, and attendant advantages of the present invention will-be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
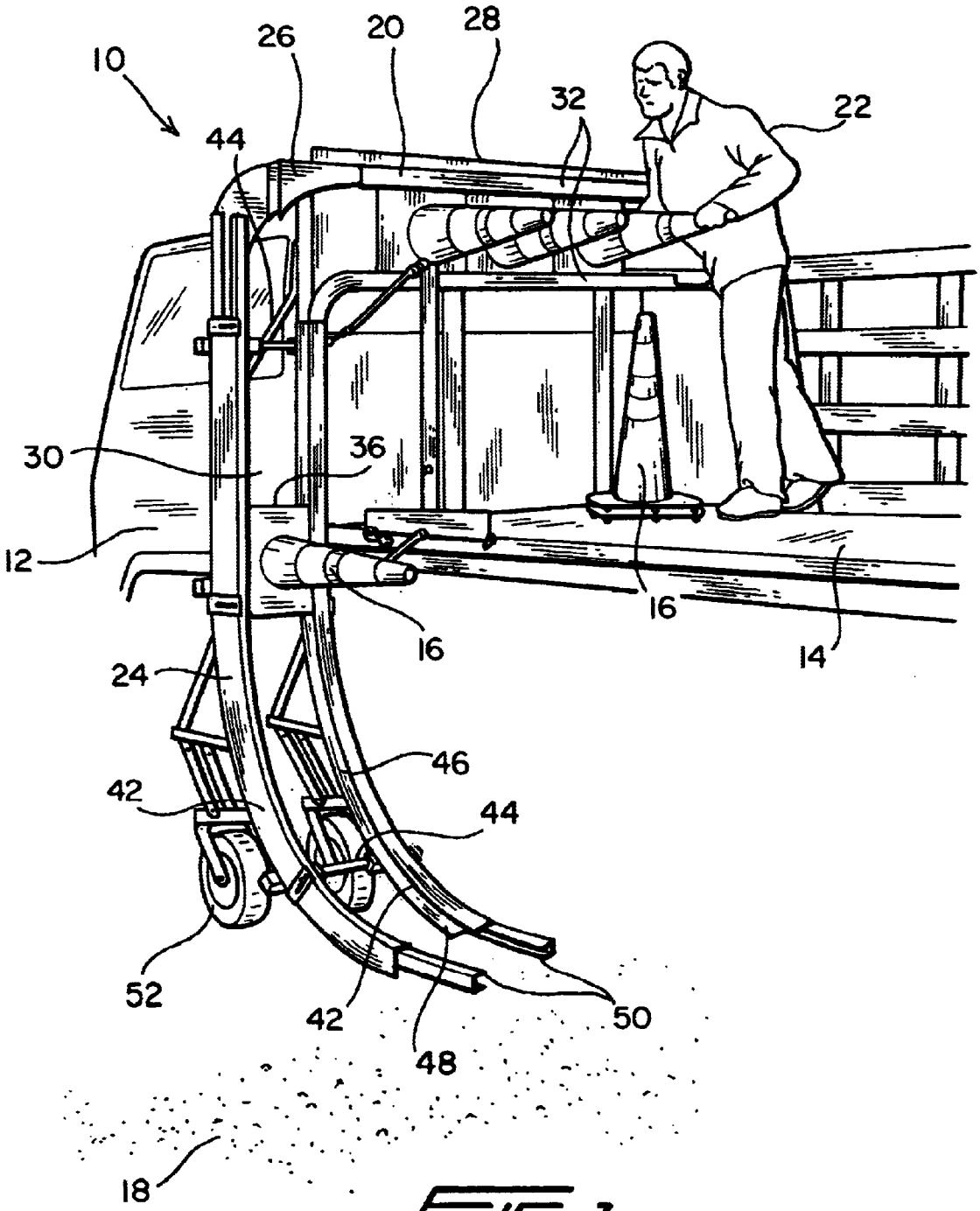
FIG. 1 is a perspective view of a first embodiment of a new and improved semi-automatic device, mechanism, system, or apparatus, for depositing or placing traffic cones onto roadway surfaces at predeterminedly spaced locations thereof and in accordance with predeterminedly timed sequence techniques or parameters, wherein an operator or workman is shown loading a plurality of traffic cones into the magazine structure of the system while a leading one of the traffic cones, which was previously loaded into the magazine structure, is shown sliding down the vertically oriented chute structure.
Figure 2:
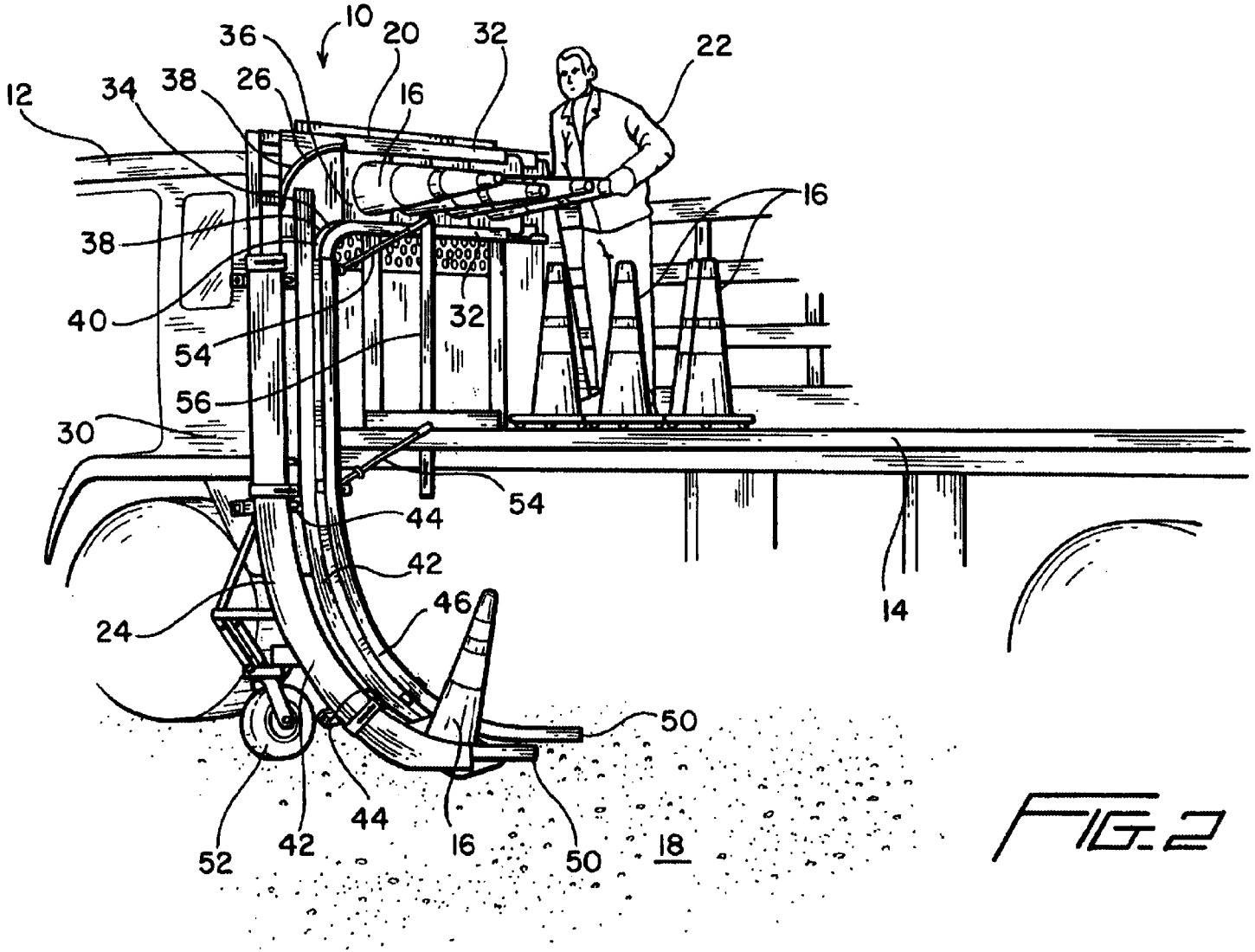
FIG. 2 is a perspective view similar to that of FIG. 1 showing, however, the disposition of the leading traffic cone at the downstream, horizontally oriented portion of the chute structure just prior to its actual deposition upon the roadway surface.

Referring now to the drawings, and more particularly to FIGS. 1 and 2 thereof, a first embodiment of a new and improved device, mechanism, system, or apparatus for depositing or placing traffic cones onto roadway surfaces is disclosed and is generally indicated by the reference character 10. The system or apparatus 10 is adapted to be fixedly mounted upon a conventional roadwork truck 12 which may have, for example, a rear deck or bed 14 upon which a plurality of nested or stacked traffic cones 16 may be placed or loaded in preparation for depositing such traffic cones 16 upon the roadway 18 in accordance with a predeterminedly timed sequence in order to place or deposit the traffic cones 16 upon the roadway surface 18 at predeterminedly spaced locations thereof. As can readily be appreciated further, the new and improved system or apparatus 10 for depositing or placing the traffic cones 16 onto the roadway surface 18 essentially comprises a horizontally disposed or oriented magazine section 20 within which a plurality of the traffic cones 16 can be manually loaded by means of an operator or workman 22, and a vertically disposed or oriented delivery chute section 24 which is integrally connected to the horizontally disposed or oriented magazine section 20 by means of a curved or arcuate transitional section 26. In this manner, the system or apparatus 10 has a substantially inverted L-shaped configuration which enables the operator or workman 22 to load a plurality of traffic cones 16 into the horizontally disposed or oriented magazine section 20 of the system or apparatus 10 from the right end portion thereof as viewed, for example, in FIG. 1, which is effectively disposed interiorly of the roadwork truck 12. Accordingly, the plurality of traffic cones 16 are continually moved toward the left end portion of the magazine section 20 until the magazine section 20 is filled with a predetermined number of traffic cones 16.

Consequently or subsequently, when it is desired to actually deposit a traffic cone 16 onto the roadway surface 18, the operator or workman loads an additional traffic cone 16 into the right end portion of the magazine 20 whereby the traffic cone 16 disposed at the extreme left end position within the magazine section 20 will be forced to move through the curved or arcuate transitional section 26 so as to enter the vertically disposed or oriented chute section 24. Accordingly, the traffic cone 16 disposed within the upper or upstream end portion of the vertically disposed or oriented chute section 24 will be conveyed downwardly under the influence of gravity toward the lower or downstream end portion of the vertically disposed or oriented chute section 24 so as to be deposited onto the roadway surface 18. The operative cycle can then of course be repeated in accordance with a predeterminedly timed sequence in order to place or deposit traffic cones 16 upon the roadway surface 18 at predeterminedly spaced positions or locations thereof. It can therefore be readily appreciated that as a result of the formation and provision of the system or apparatus 10 of the present invention, the traffic cones 16 can be desirably deposited or placed upon the roadway surface 18 under the operative control of the operator or workman 22, however, the operator or workman 22 is always safely positioned upon an interior portion of the rear deck or bed portion 14 of the roadwork truck 12 so as not to be disposed in a precarious position which would otherwise expose the operator or workman 22 to dangerous situations which may be presented by means of oncoming vehicular traffic. Still further, since the operator or workman 22 needs to only load the individual traffic cones 16 into the magazine section 20 of the system or apparatus 10, and not actually place or deposit the traffic cones 16 onto the roadway surface 18 while simultaneously supporting himself or herself in a usually precarious position or orientation, the entire traffic cone deposition operation is less ergonomically destructive and fatiguing with respect to the operator's or workman's body.

With reference still being made to FIGS. 1 and 2, the typical roadwork truck 12, in addition to having the rear deck or bed portion 14, also has a rear, vertically upstanding wall portion 28 which is secured to the rear wall section of the truck's front cab or driver section 30 by means of suitable fasteners, not shown, and effectively serves to separate the cab or driver section 30 from the rear deck or bed portion 14. The magazine section 20 of the system or apparatus 10 is, in turn, adapted to be fixed to the rear wall portion 28 by means of suitable fasteners, not shown, and more particularly, it is seen that the magazine section 20 comprises a pair of vertically spaced rail members 32,32 which are adapted to be individually fixed to the rear wall portion 28 by means of suitable fasteners, also not shown. Each one of the rail members 32 comprises a three-wall U-shaped structure effectively defining a grooved portion or track section 34 upon an interior portion thereof, only the lower track section 34 being visible in FIG. 2, whereby the grooved track sections 34,34 of the oppositely disposed or vertically spaced rail members 32,32 operatively cooperate together so as to accommodate opposite edge portions of the substantially square-shaped base section 36 of each traffic cone 16. In this manner, when each traffic cone 16 is loaded into the magazine section 20 as a result of the base section 36 of the particular traffic cone 16 being slidably inserted into the track sections 34,34 of the rail members 32,32 from the extreme right end portion of the magazine section 20, the traffic cones 16 are fixedly retained within the magazine section 20 so as to only be laterally movable therein. When each traffic cone 16 is in fact retained within the track sections 34,34 of the rail members 32,32, the traffic cones 16 are disposed in a horizontal orientation, that is, the axis of each traffic cone 16, around which the conical structure is geometrically defined, is disposed horizontally.

In a manner similar to that of the rail members 32,32 of the magazine section 20, the transitional region 26 of the system or apparatus 10 likewise comprises a pair of curved or arcuately configured rail members 38,38 each of which comprises a three-wall U-shaped structure effectively defining a grooved portion or track section 40,40 formed upon interior portions thereof, only the lower track section 40 being visible in FIG. 2. Still further, and in a manner similar to that of the magazine rail members 32,32 and the transitional region rail members 38,38, the vertically oriented chute section 24 likewise comprises a pair of oppositely disposed, laterally spaced rail members 42,42. A plurality of transversely oriented fixation or stabilization bars 44 are fixedly connected to the rail members 42,42 at upstream, intermediate, and downstream portions thereof so as to fixedly maintain the lateral spacing defined between the rail members 42,42 throughout the longitudinal extent thereof, and each one of the rail members 42,42 comprises a three-wall U-shaped structure effectively defining a grooved portion or track section 46 formed upon an interior surface portion thereof, only the grooved track section 46 formed within the right one of the rail members 42,42 being visible in FIGS. 1 and 2.

It is further appreciated that an intermediate section of each one of the rail members 42,42 of the vertically oriented chute section 24 has an arcuate or curved configuration such that the upper, upstream end portion of each one of the rail members 42,42 of the vertically oriented chute section 24, which is integrally connected to the transitional region 26, is disposed within a vertical plane, while the lower, downstream end portion of each one of the rail members 42,42 of the vertically oriented chute section 24 is disposed within a horizontal plane. In this manner, as can be readily appreciated from FIGS. 1 and 2, as the traffic cones 16 serially move from the magazine section 20 of the system or apparatus 10 and into the vertically oriented chute section 24, and still further, as the traffic cones 16 subsequently traverse the vertically oriented chute section 24, the orientation of the traffic cones 16 will be changed from a horizontal disposition to a vertical disposition so as to effectively automatically permit the traffic cones 16 to be deposited onto the roadway surface 18 in their desired standup mode.

As can be further appreciated from FIGS. 1 and 2, in order to effectively assist the deposition of the traffic cones 16 onto the roadway surface 18 in their erected or standup modes, it is seen that the rear or bottom base wall section 48 of each three-wall U-shaped structure effectively defining the grooved portion or track section 46 of each rail member 42,42, upon which each traffic cone 16 is actually supported during its vertically downward and arcuate movement, is terminated at its downstream end portion prior to or short of the termination of each corresponding rail member 42,42 at its downstream end portion. This particular structure therefore permits each traffic cone 16 to be released from the downstream end portion of the chute section 24 and effectively simply drop vertically downwardly onto its square-shaped base section 36 for proper placement upon the roadway surface 18. In conjunction with such deposition of the traffic cones 16 onto the roadway surface 18, it is noted further that free terminal end portions 50,50 of the rail members 42,42 will nevertheless be disposed above the laterally outwardly extending portions of the base section 36 of the traffic cone 16, as the traffic cone 16 is deposited onto the roadway surface 18 and as the roadwork truck or vehicle 12 continues to move along the roadway surface 18, so as to effectively prevent any tipping over of the traffic cone 16 and thereby ensure the proper deposition of the traffic cone 16 upon the roadway surface 18 in its desired erected or standup mode. It is to be noted that, in accordance with the principles and teachings of the present invention, while the new and improved traffic cone deposition system or apparatus 10 has been illustrated as being secured to the roadwork truck 12 in such a manner that the magazine section 20 feeds the traffic cones 16 toward the left side of the roadwork truck 12 and that, accordingly, the vertically oriented chute section 24 is located upon the left side of the roadwork truck 12, the system or apparatus 10 of the present invention can effectively be reversed.

More particularly, the system or apparatus 10 of the present invention can be mounted upon the roadwork truck 12 such that the traffic cones 16 are fed through the magazine section 20 toward the right side of the roadwork truck 12, and concomitantly therewith, the vertically oriented chute section 24 can likewise be located upon the right side of the roadwork truck 12. In order to support the new and improved traffic cone deposition system or apparatus 10 of the present invention upon either side portion of the roadwork truck or vehicle 12, as well as upon the roadway surface 18, in a stabilized manner, it is further seen that the new and improved traffic cone deposition system or apparatus 10 of the present invention comprises a wheel assembly 52 which is operatively connected to the vertically oriented chute section 24 by means of suitable mounting brackets and the like. In this manner, the terminal end portions 50,50 of the rail members 42,42 will be supported at a predetermined elevational level above the roadway surface, as can best be appreciated from FIG. 2, so as to facilitate the deposition of each traffic cone 16 onto the roadway surface 18. In a similar manner, in order to further stably support the traffic cone deposition system or apparatus 10 in a lateral or transverse manner upon the roadwork truck or vehicle 12, as well as with respect to its stabilized upright orientation upon the roadway surface 18, a pair of support rodturnbuckle structures 54,54 interconnect the vertical sections of the chute rail members 42,42 to suitable mounting bracket structure 56 fixedly secured to the roadwork truck or vehicle 12.

Figure 3:
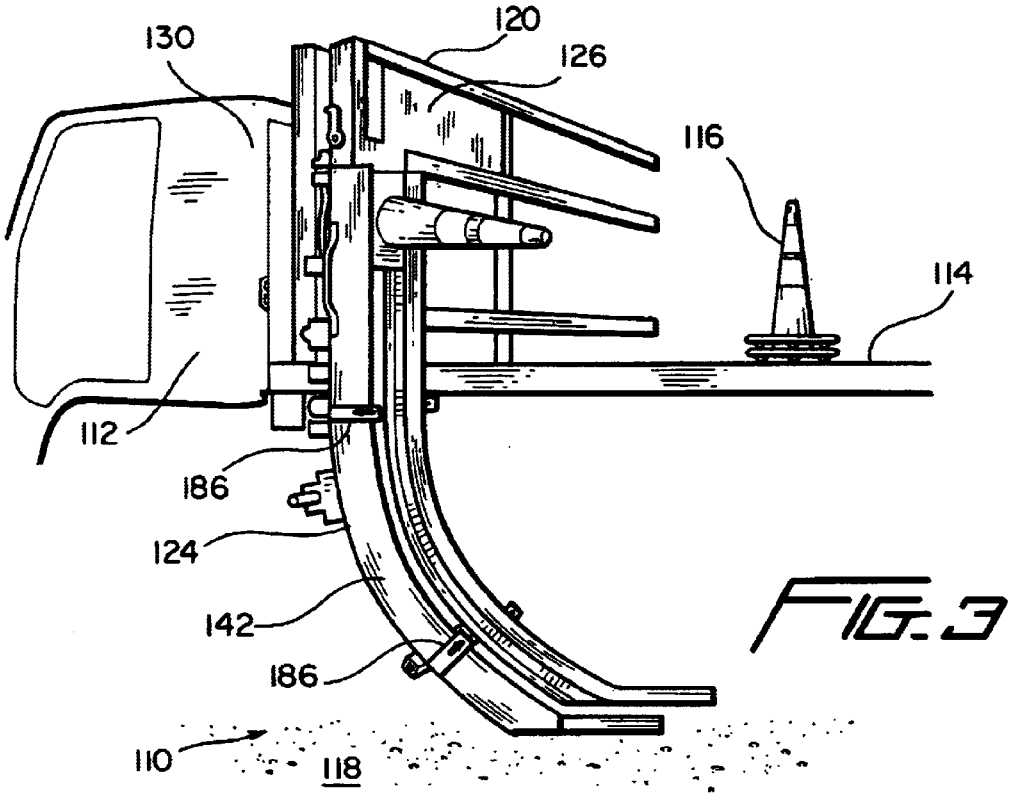
FIG. 3 is a perspective view similar to that of FIG. 2 showing, however, a second embodiment of a new and improved automatic device, mechanism, system, or apparatus, for depositing or placing traffic cones onto roadway surfaces at predeterminedly spaced locations thereof and in accordance with predeterminedly timed sequence techniques or parameters, wherein an operator or workman loads a plurality of traffic cones into the magazine structure of the system, however, the discharge of the leading one of the plurality of traffic cones, which were previously loaded into the magazine structure, is automatically controlled for sliding down the vertically oriented chute structure in accordance with the aforenoted timed or distance measuring sequence.

With reference now being made to FIG. 3, a second embodiment of a new and improved automatic device, mechanism, system, or apparatus, for depositing or placing traffic cones onto roadway surfaces at predeterminedly spaced locations thereof and in accordance with predeterminedly timed sequence techniques or parameters, is disclosed and is generally indicated by the reference character 110. It is initially noted that the second embodiment automatic system or apparatus 110 is quite similar to the first semi-automatic system or apparatus 10, except as will be noted hereinafter, and accordingly, the following detailed description of the second embodiment automatic system or apparatus 110 will concentrate upon the differences between the systems. It is additionally noted that components parts of the second embodiment system or apparatus 110 which correspond to similar component parts of the first embodiment system or apparatus 10 will be designated by corresponding reference characters except that the reference characters will be within the 100 series. More particularly then, as was the case with the first semi-automatic embodiment system or apparatus 10 as disclosed within FIGS. 1 and 2, it is seen that the second embodiment automatic system or apparatus 110 is likewise adapted to be fixedly mounted upon a conventional roadwork truck or vehicle 112 which may have, for example, a rear deck or bed 114 upon which a plurality of traffic cones 116 may be placed or loaded in preparation for depositing such traffic cones 116 upon the roadway 118 in accordance with a predeterminedly timed sequence in order to place or deposit the traffic cones 116 upon the roadway surface 118 at predeterminedly spaced locations thereof.

Figure 5:
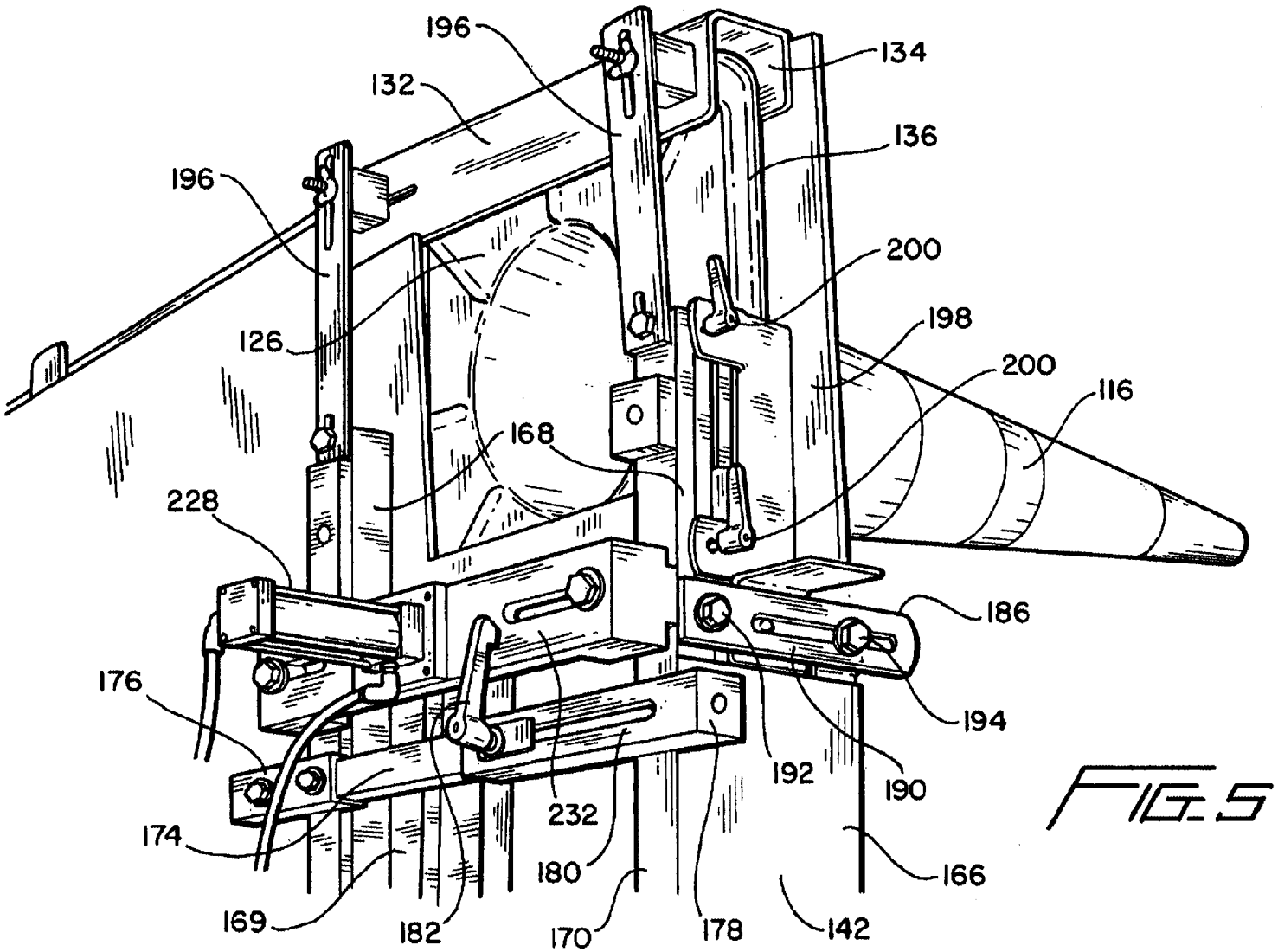
FIG. 5 is a perspective view of the left side, upper corner portion of the traffic cone discharge system at the intersection of the magazine and chute sections of the discharge system, looking from the front of the roadwork vehicle or truck and showing one of the traffic cones being retained at its uppermost READY position within the vertical chute section of the discharge system in preparation for its movement into its lowered DISCHARGE position.

The new and improved system or apparatus 110 for depositing or placing the traffic cones 116 onto the roadway surface 118 essentially comprises a horizontally disposed or oriented magazine section 120 within which a plurality of the traffic cones 116 can be manually loaded by means of an operator or workman, and a vertically disposed or oriented delivery chute section 124 which is adapted to be connected to the horizontally disposed or oriented magazine section 120 by means of a corner region 126. In this manner, the system or apparatus 110 has a substantially inverted L-shaped configuration which enables the operator or workman to load a plurality of traffic cones 116 into the horizontally disposed or oriented magazine section 120 of the system or apparatus 110 from the right end portion thereof as viewed, for example, in FIG. 3, which is effectively disposed interiorly of the roadwork truck 112. Accordingly, the plurality of traffic cones 116 are continually moved toward the left end portion of the magazine section 120 and the corner region 126 until the magazine section 120 is filled with a predetermined number of traffic cones 116, and in addition, a traffic cone 116 is also disposed within the corner region 126 as shown in FIG. 5. Subsequently, the traffic cones 116 will be serially and sequentially released from the corner region 126 of the system or apparatus 110 into the vertically disposed or oriented delivery chute section 124 of the system or apparatus 110 so as to in fact be deposited upon the roadway surface 118 in accordance with predeterminedly timed sequences so as to place the traffic cones 116 at predeterminedly spaced locations upon the roadway surface 118.

Figure 4:
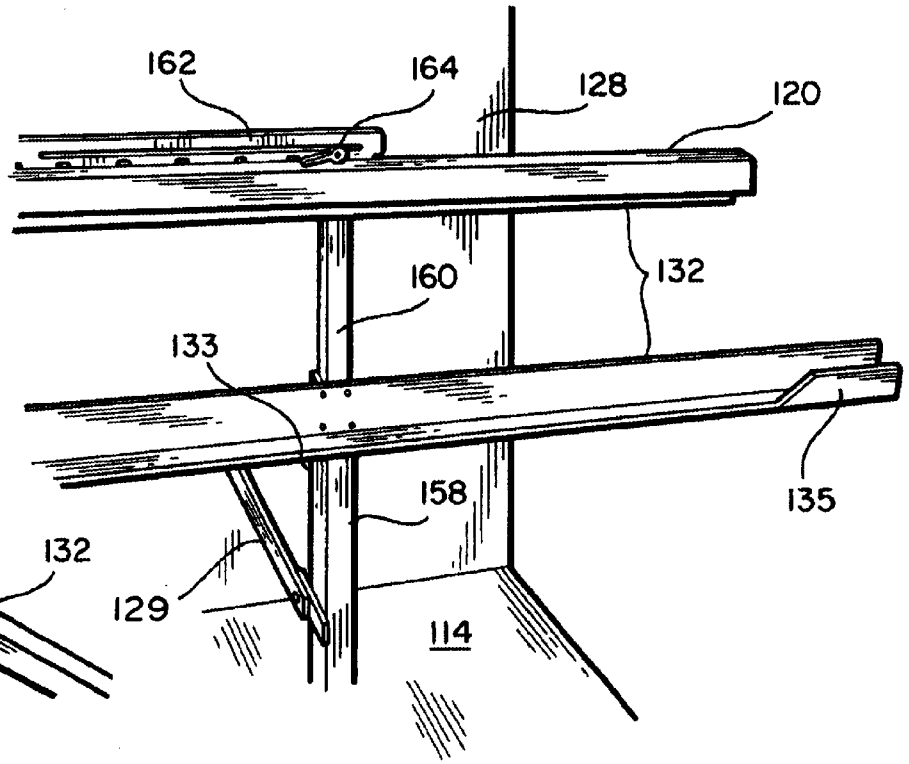
FIG. 4 is front perspective view of the right side portion of the traffic cone loading magazine of the second embodiment apparatus or system shown in FIG. 3.
Figure 6:
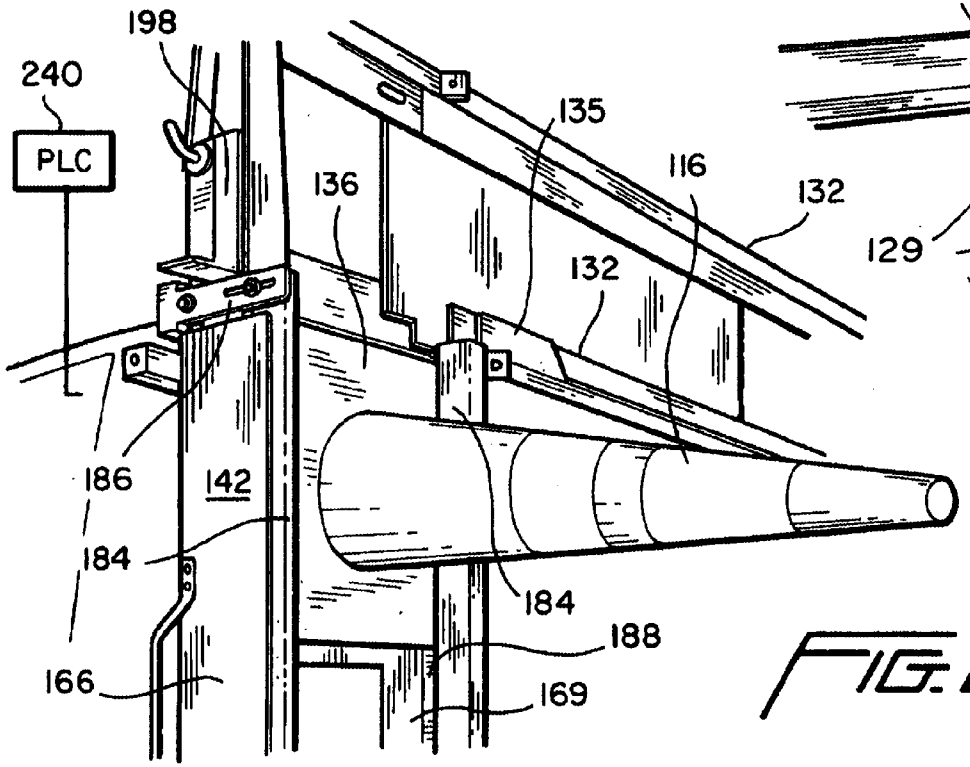
FIG. 6 is a perspective view of the left side, upper corner portion of the traffic cone discharge system at the intersection of the magazine and chute sections of the discharge system, looking from the rear of the roadwork vehicle or truck and showing one of the traffic cones being retained at its lowered DISCHARGE position within the vertical chute section of the discharge system just prior to its release for downward movement within the vertical chute section of the discharge system so as to be placed upon the roadway surface.

The typical roadwork truck or vehicle 112, in addition to having the rear deck or bed portion 114, also has a rear, vertically upstanding wall portion 128 which is secured to the rear wall section of the truck's front cab or driver section 130 by means of suitable brackets and fasteners, not shown, and effectively serves to separate the cab or driver section 130 from the rear deck or bed portion 114. The magazine section 120 of the system or apparatus 110 is, in turn, adapted to be fixed to the rear wall portion 128 by means of suitable brackets 129 as shown in FIG. 4, and more particularly, it is seen that the magazine section 120 comprises a pair of vertically spaced, horizontally disposed rail members 132,132 which are adapted to be mounted upon a plurality of upstanding support beams 133. Both the upper and lower rail members 132 may comprise, in effect, three-wall, inverted U-shaped structures defining oppositely disposed track sections 134, as best seen in FIG. 5, for cooperating together in confining the substantially square-shaped base section 136 of each traffic cone 116 therebetween. Alternatively, the lower one of the rail members 132 may simply comprise, in effect, an L-shaped angle iron structure throughout substantially the entire length thereof, however, as illustrated within FIGS. 4 and 6, the extreme right and left end portions 135 of the lower rail member 132 preferably have a substantially U-shaped structure so as to initially facilitate the seating and confinement of the substantially square-shaped base section 136 of each traffic cone 116 as the traffic cone 116 is loaded into the magazine section 120. Since the traffic cones 116 will be disposed with their longitudinal axes disposed horizontally when in fact mounted within the magazine section 120, as can best be appreciated from FIG. 5, it is understood that the lower rail member 132 need only be substantially L-shaped in configuration because the weight of each rearwardly facing traffic cone 116 will tend to tilt the same slightly downwardly, that is, the longitudinal axis thereof will be disposed slightly downwardly, whereby the upper edge portion of the traffic cone base 136 will be fixedly retained within the U-shaped track portion 134 of the upper rail member 132 so as to effectively prevent any inadvertent and premature dislodging of the traffic cones 116 from the magazine section 120 prior to the serial disposition of the traffic cones 116 within the corner region 126 in preparation for their ultimate discharge into the vertical chute section 124.

Figure 8:
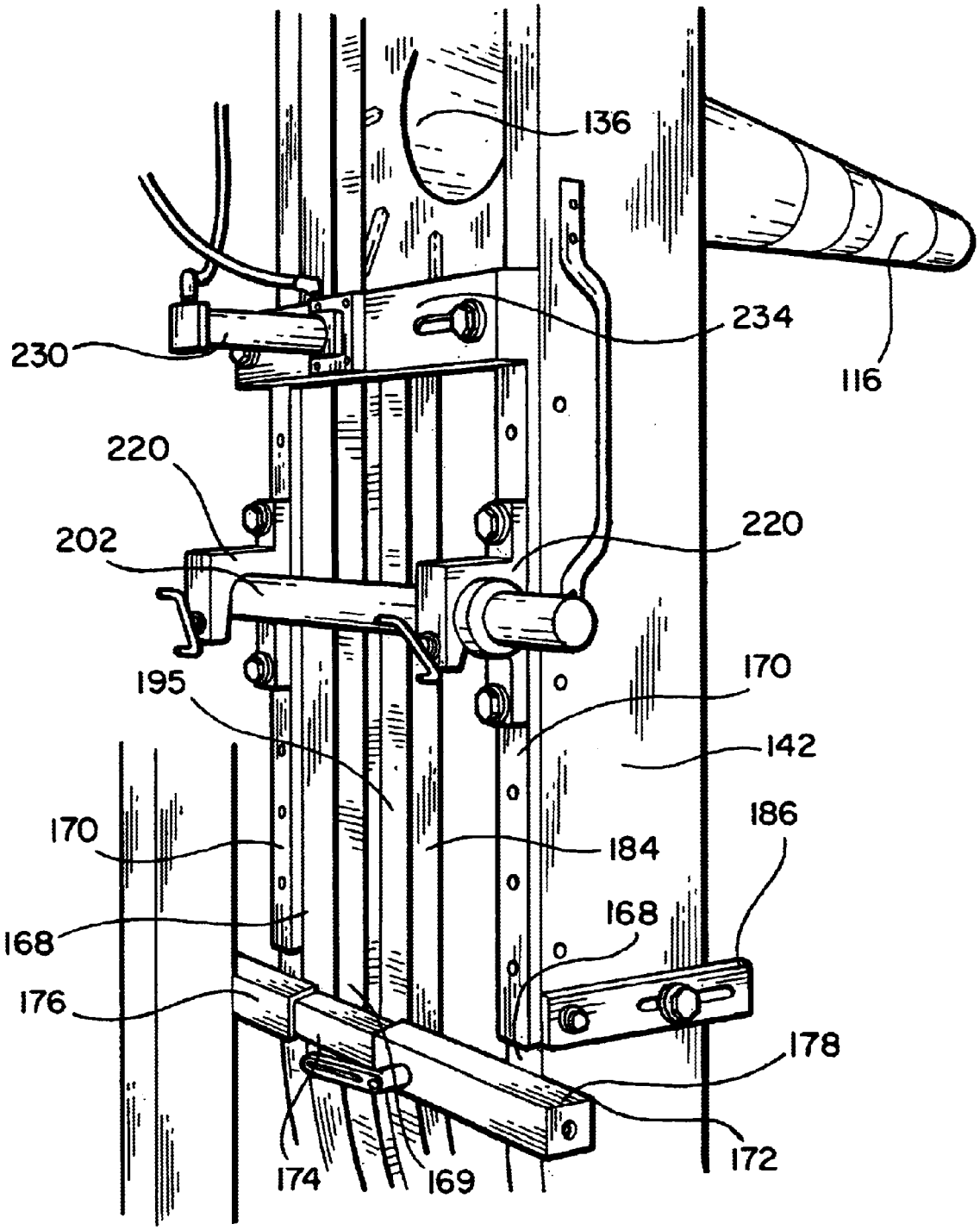
FIG. 8 is a perspective side view of the roadwork vehicle or truck illustrating a first one of the support systems for suspendingly mounting the vertically oriented delivery chute in a cantilevered manner upon the bed of the roadwork vehicle or truck.

In order for the system or apparatus 110 to be capable of accommodating different sized traffic cones 116 having, for example, base sections 136 having different dimensions, the relative vertical spacing defined between the upper and lower rail members 132,132 of the magazine section 120 may be accordingly adjusted. More particularly, as best seen in FIGS. 4 and 8, each one of the plurality of upstanding support beams 133 actually comprises a lower upstanding beam member 158 fixedly mounted upon the truck or vehicle bed or deck 114, and an upper vertically oriented beam member 160 which is telescopically received within the lower beam member 158, adjustable fastening means, not shown, being provided in conjunction with such members 158, 160 so as to adjustably lock the upper member 160 at a particular elevation with respect to the lower member 158. The lower rail member 132 is fixedly secured to each one of the lower upstanding beam members 158, while the upper rail member 132 is adjustably secured to the upper ends of each one of the upper beam members 160 through means of a plurality of slotted brackets 162 such that the upper rail member 132 can be positionally adjusted with respect to the lower rail member 132 in the lateral or transverse direction.

The reason for this is, as can be readily appreciated from FIG. 4, the lower rail member 132 necessarily has a longitudinal extent which is greater than that of the upper rail member 132 such that when the system or apparatus 110 of the present invention is disposed and secured upon the left side of the roadwork vehicle or truck 112 as seen in FIG. 3, the right side U-shaped portion 135 of the lower rail member 132 will project or extend beyond that longitudinal extent of the upper rail member 132 so as to facilitate insertion of the traffic cones 116 into the right side of the magazine section 120. Alternatively, if the system or apparatus 110 of the present invention is to be disposed and secured upon the right side of the roadwork vehicle or truck 112, the left U-shaped portion 135 of the lower rail member 132 needs to project or extend beyond the longitudinal extent of the upper rail member 132 so as to likewise facilitate insertion of the traffic cones 116 into the left side of the magazine section 120. Accordingly, by means of the slotted brackets 162, and threaded bolt fasteners 164 operatively associated therewith, which are adapted to be threadedly inserted into internally threaded bores, not shown, defined within the upper ends of the upper beam members 160, the upper rail member 132 may be laterally shifted between extreme left and right positions depending upon whether the system or apparatus 110 of the present invention is to be mounted and secured upon the left or right side of the roadwork vehicle or truck 112.

Figure 7:
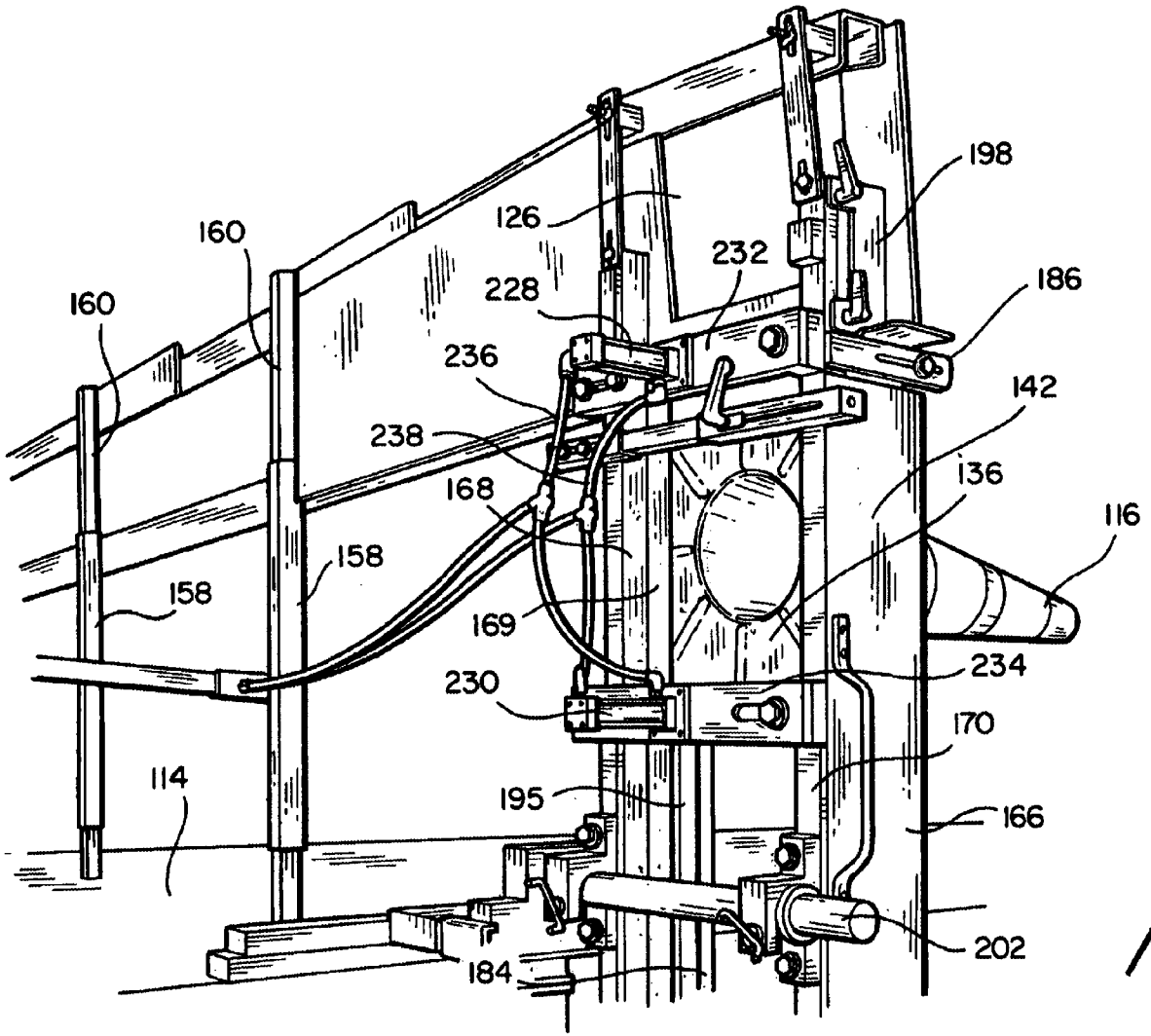
FIG. 7 is a perspective view of the left side, upper corner portion of the traffic cone discharge system at the intersection of the magazine and chute sections of the discharge system, looking from the front of the roadwork vehicle or truck, showing the traffic cone retained at its lowered DISCHARGE position within the vertical chute section of the discharge system just prior to its release for downward movement within the vertical chute section of the discharge system so as to be placed upon the roadway surface, as shown in FIG. 6, and illustrating the dual double-acting piston-cylinder control system for controlling the downward movement of the traffic cone within the vertical chute section when the traffic cone is disposed at both the READY and DISCHARGE positions.

With reference now being made to FIGS. 5–9, similar rail structure, and adjustability thereof, is provided in connection with the vertically disposed or oriented delivery chute section 124. More particularly, left and right sides 142 of the vertically disposed or oriented delivery chute section 124 are formed by means of primary rail members 168,168 having side cover plates 166 fixedly bolted thereto. The cover plates 166 will therefore confine the base section 136 of each traffic cone 116 in the widthwise direction, and the primary rail members 168 have sheets 169 of a suitable friction-reducing material, such as, for example, DELRIN®, NYLON®, or the like, secured to the inner surfaces thereof so as to effectively provide seating surfaces upon which opposite side edge portions of the base section 136 of the traffic cone 116 will be supportably disposed when the particular traffic cone 116 is present within the delivery chute section 124. Elongated mounting or bracket bars 170 are fixedly secured upon the forward-facing surfaces of the primary rail members 168, as best seen in FIGS. 7 and 8, and a plurality of transversely oriented, adjustment and stabilization bar assemblies 172 are adapted to be connected to the forward-facing surfaces of the primary rail members 168. Each adjustment and stabilization bar assembly 172 comprises a bar member 174 fixedly secured to the forward-facing surface of the inner primary rail member 168 by means of a mounting bracket 176, while a tubular bar housing 178 is fixedly secured to the forward-facing surface of the outer primary rail member 168 as best appreciated from FIG. 9. The tubular bar housing 178 is slotted as at 180, while a threaded fastener 182, for threaded engagement within a threaded bore, not shown, provided within the end of the bar member 174, passes through the slot 180 so as to fix the bar member 174 and the housing 178 together when the fastener 182 is appropriately tightened. Accordingly, the transverse distance defined between the oppositely disposed rail members 168,168, as well as between the cover plates 166,166, is determined so as to define the width dimension of the delivery chute 124, and in addition, the bar assemblies 172 also provide lateral stability to the delivery chute 124.

Continuing further, in order to similarly define the depth of the channel, as considered in the forward-rearward direction, for accommodating the thickness dimension of the base section 136 of each traffic cone 116, and for appropriately confining the base section 136 of the traffic one 116 as each traffic cone 116 moves vertically downwardy within the delivery chute section 124, secondary rail embers 184 are adapted to be fixedly mounted within the delivery chute section 124. More particularly, as can be appreciated from FIGS. 3 and 5–8, a plurality of adjustable bracket assemblies 186 are utilized at predetermined locations along the longitudinal arcuate extent of the entire delivery chute section 124 for fixedly positioning the secondary rail members 184 with respect to the primary rail members 168,168 so as to effectively space the secondary rail members 184 from the primary rail members 168 and thus define a channel 188 therebetween within which the base section 136 of each traffic cone 116 can be accommodated.

As can best be seen from FIG. 5, each one of the adjustable bracket assemblies 186 comprises a slotted bracket member 190 which is bolted at one end thereof to the primary rail member 168, as at 192, while a bolt fastener 194 is passed through the slotted portion of the bracket member 190 so as to be threadedly engaged within a threaded bore, not shown, defined within the secondary rail member 184. Adjustment of the bolt fastener 194 within the slotted portion of the bracket member 190 will accordingly permit spatial adjustment of each secondary rail member 184 with respect to each primary rail member 168. In a manner similar to that of the primary rail members 168, sheets 195 of a suitable friction-reducing material, such as, for example, DELRIN®, NYLON®, or the like, are secured to the inner surfaces of the secondary rail members 184, as best seen in FIGS. 7 and 8, so as to operatively cooperate with the friction-reducing sheets 169 disposed upon the primary rail members 168 and thereby effectively facilitate the sliding movement of the base sections 136 of the traffic cones 116 within the space or channel 188 as the traffic cones 116 move downwardly within the vertically oriented chute section 124. In order to effectively complete the fixed connection of the vertically oriented chute section 124 to the magazine section 120 through means of the corner region 126, it is seen that, as best illustrated within FIG. 5, connection brackets 196 fixedly interconnect upper end portions of the primary rail members 168 of the vertically oriented chute section 124 to the upper rail member 132 of the magazine section 120. Still further, a side cover plate 198 is also fixedly bolted as at 200 to the outer primary rail member 168 of the vertically oriented chute section 124 so as to effectively close the open side of the corner region 126 and thereby prevent the inadvertent discharge of the leading or downstream one of the traffic cones 116 from the magazine section 120 and the corner region 126.

Figure 9:
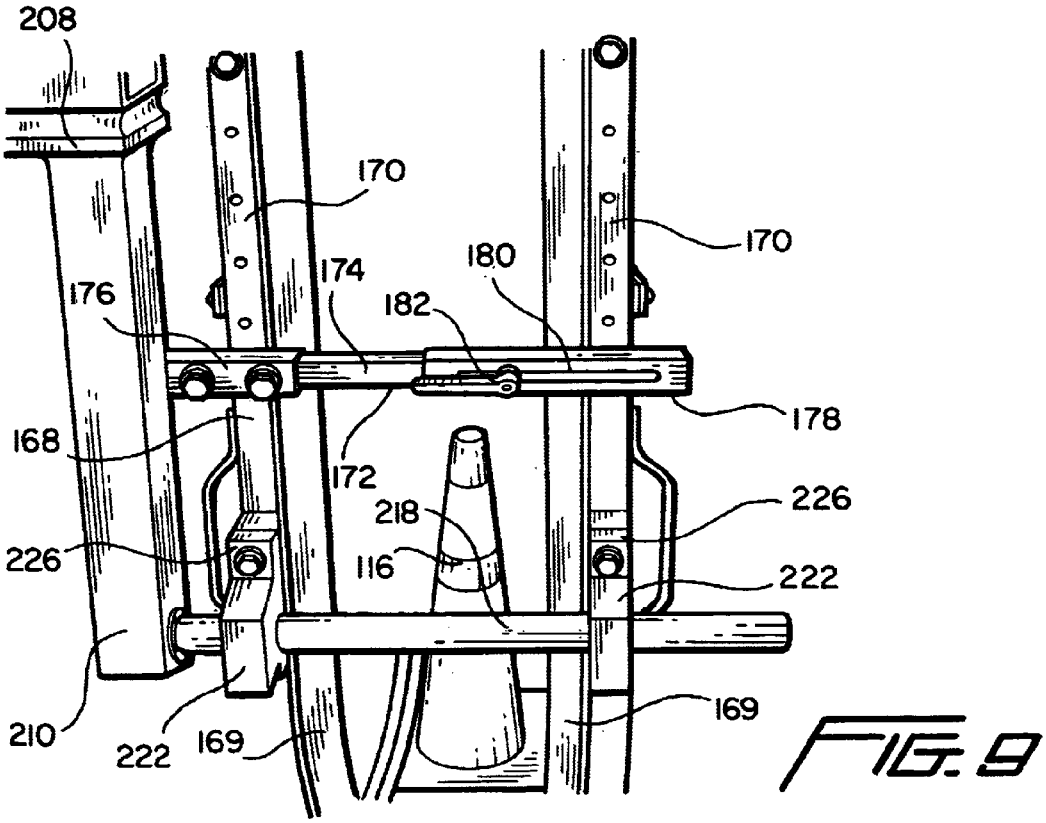
FIG. 9 is a front elevational view of a second one of the support systems for suspendingly mounting the vertically oriented delivery chute in a cantilevered manner upon the bed of the roadwork vehicle or truck.

Lastly, in connection with the actual mounting of the system or apparatus 110 upon the roadwork truck or vehicle 112, it is seen that a dual hanger assembly is provided for suspendingly supporting the vertically oriented chute section 124 of the system or apparatus 110 from the outer side portion of the roadwork vehicle or truck 112 in a substantially cantilevered manner as illustrated within FIGS. 7–9. More particularly, a first upper hanger rod 202 is integrally connected in a cantilevered manner to a mounting block 204 which is bolted atop a tubular mounting bracket 206. The mounting bracket 206 is, in turn, welded to an upper surface of a mounting plate 208, while a vertically downwardly extending dependent support shaft 210 is welded to an undersurface portion of the mounting plate 208. The mounting plate 208 has adjustable bolt fasteners 212 engaging the underside of a clevis plate assembly 214, and it is seen that the clevis plate assembly 214 projects laterally outwardly from a set of tubular shaft members 216 which are fixedly mounted within a side rail portion 217 of the roadwork truck or vehicle bed 114. A D-shaped hinge housing 215 has a flanged plate portion 213 bolted between the clevis plate assembly 214, and a plate member 211, which is hingedly connected at one thereof to the D-shaped housing 215 by means of pivot pins 209, is bolted to the mounting bracket 206 along with the mounting block 204.

Figure 8A:
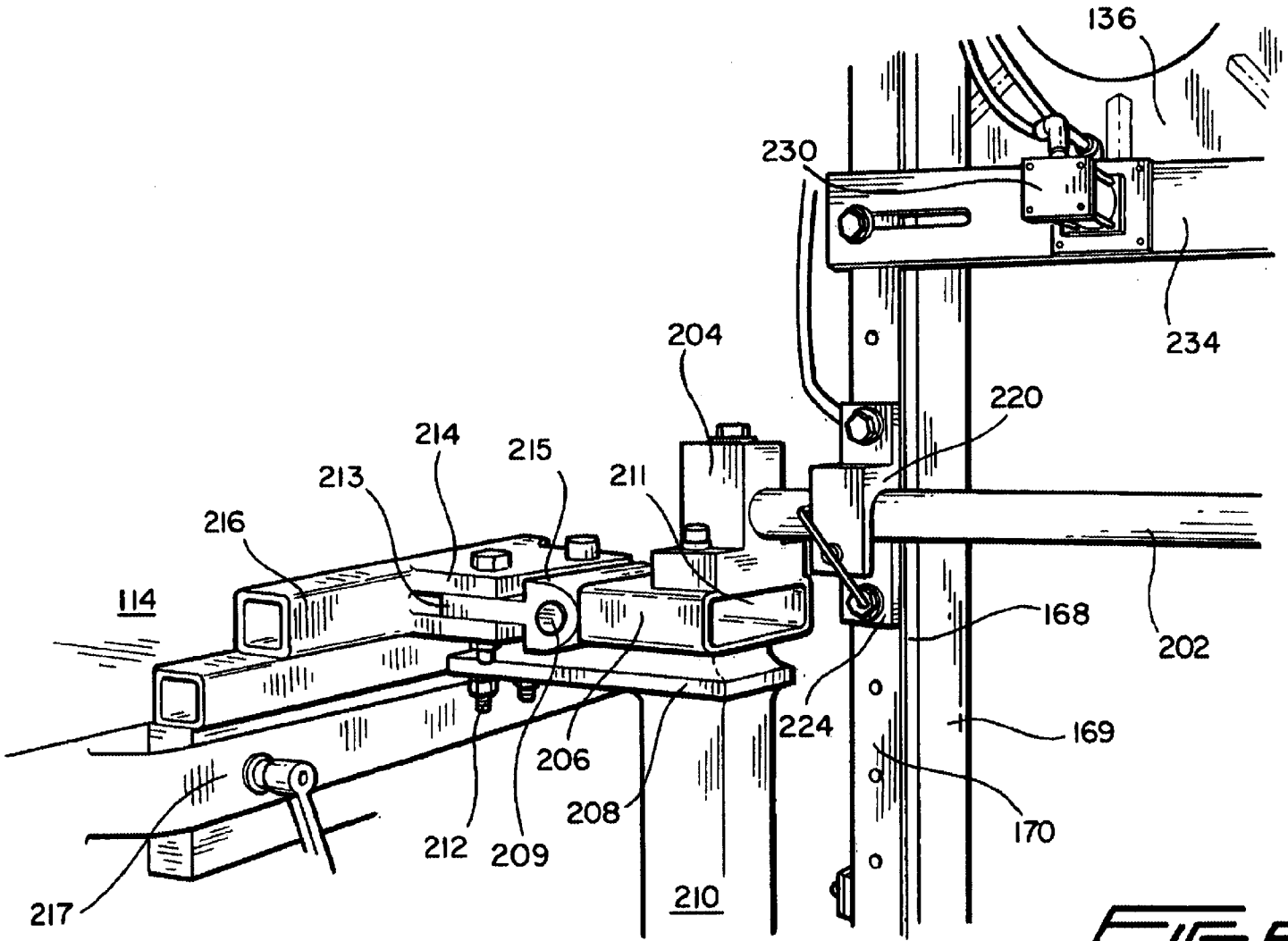
FIG. 8*a* is an enlarged perspective view showing the details of the support system for suspendingly mounting the vertically oriented delivery chute in a cantilevered manner, as shown in FIG. 8, upon the bed of the roadwork truck or vehicle bed.

In this manner, the entire hanger assembly may be pivoted to a position overlying the roadwork vehicle or truck bed 114 when the system or apparatus 110 is not actually being used to deposit traffic cones 116 onto the roadway surface 118. As best seen in FIG. 9, the system or apparatus 110 also comprises a second lower hanger rod 218 which projects laterally outwardly in a cantilevered manner from a lower end portion of the support shaft 210, and first and second, upper and lower pairs of substantially inverted U-shaped hanger brackets 220,222 are respectively suspendingly supported upon the upper and lower hanger rods 202, 218. Each one of the upper hanger brackets 220 has a mounting flange portion 224 integral therewith for bolted connection to the mounting bars 170, fixedly mounted upon the primary rail members 168, as best seen in FIG. 8*a*, while each one of the lower hanger brackets 222 is also provided with an integral mounting flange portion 226 for bolted connection to the mounting bars 170 as best seen in FIG. 9.

With reference lastly being made to FIGS. 5,7,8, and 8*a*, a new and improved control system, as developed and constructed in accordance with the principles and teachings of the present invention for automatically controlling the release and discharge of the leading one of the traffic cones 116, which is disposed within the magazine section 120 of the system or apparatus 110 of the present invention, and more particularly, when such leading traffic cone 116 is in fact disposed within the corner region 126 of the system or apparatus 110, will now be described. As can best be appreciated from FIGS. 5 and 7, the control system of the present invention is seen to comprise first and second, upper and lower, dual-acting pneumatic piston-cylinder assemblies 228,230, and it is seen that the piston-cylinder assemblies 228,230 are respectively mounted upon adjustable mounting brackets 232,234 which are adapted to be bolted to the mounting bars 170. The upper piston-cylinder assembly 228 is seen to be mounted at an elevational level which is located immediately beneath the corner region 126, and consequently, when the piston rod, not shown, of the upper piston-cylinder assembly 228 is extended, the piston rod, or a support plate operatively connected thereto and likewise not shown, will be correspondingly extended so as to project into the vertically oriented chute section 124, between the laterally spaced primary and secondary rail members 168, 184, and beneath the base section 136 of the traffic cone 116 disposed at a READY position within the corner region 126 as shown in FIG. 5 so as to in fact support the traffic cone 116 at such position in preparation for its subsequent release into the vertically oriented chute section 124.

In a similar manner, the lower piston-cylinder assembly 230 is seen to be mounted at an elevational level which is located immediately beneath the upper piston-cylinder assembly 228 by means of a distance corresponding substantially the dimension characterizing one side of the substantially square-shaped base section 136 of the traffic cone 116. Consequently, when the piston rod, not shown, of the lower piston-cylinder assembly 230 is extended, the piston rod, or a support plate operatively connected thereto and likewise not shown, will be correspondingly extended so as to also project into the vertically oriented chute section 124, between the laterally spaced primary and secondary rail members 168,184, and beneath the base section 136 of the traffic cone 116 now disposed at a DISCHARGE position located within the upper region of the chute section 124 as shown in FIG. 7 so as to in fact support the traffic cone 116 at such position in preparation for its imminent release into the vertically oriented chute section 124. Each one of the upper and lower piston-cylinder assemblies 228,230 has pneumatic control lines 236,238 operatively connected thereto, and the control lines 236,238 are adapted to be operatively connected to a program logic controller (PLC) 240 which will control the supply of pneumatic signals to the control lines 236,238, the program logic controller (PLC) 240 being mounted upon the roadwork vehicle or truck 112 and being simply disclosed schematically in FIG. 6. It is seen that a first branch of the first pneumatic control line 236 is fluidically connected to the cylinder end of the first upper piston-cylinder assembly 228 while a second branch of the first pneumatic control line 236 is fluidically connected to the piston end of the second lower piston-cylinder assembly 230. In a similar manner, a first branch of the second pneumatic control line 238 is fluidically connected to the cylinder end of the second lower piston-cylinder assembly 230 while a second branch of the second pneumatic control line 238 is fluidically connected to the piston end of the first upper piston-cylinder assembly 228. It can therefore be appreciated that when a pneumatic signal is conducted through the first pneumatic control line 236, the piston rod of the first upper piston-cylinder assembly 228 will be extended while the piston rod of the second lower piston-cylinder assembly 230 will be retracted, and conversely, when a pneumatic signal is conducted through the second pneumatic control line 238, the piston rod of the first upper piston-cylinder assembly 228 will be retracted while the piston rod of the second lower piston-cylinder assembly 230 will be extended.

Accordingly, when, for example, a first traffic cone 116 is disposed at the lower DISCHARGE position as seen in FIG. 7, and a pneumatic signal is conducted through the first pneumatic control line 236, that traffic cone 116 will be RELEASED downwardly into the vertically oriented chute section 124 for deposition or placement upon the roadway surface 118. At the same time, the extended piston rod of the first upper piston-cylinder assembly 228 will now be capable of supporting a second traffic cone 116 at the READY position in a RETAINED mode when the roadwork truck or vehicle operator or workman moves the traffic cones 116 through the magazine section 120. Subsequently, when the pneumatic signals are effectively reversed such that a pneumatic signal is now conducted through the second pneumatic control line 238, the piston rod of the upper piston-cylinder assembly 228 will be retracted while the piston rod of the lower piston-cylinder assembly 230 will be extended. Accordingly, the second traffic cone 116 disposed at the READY position within the corner region 126, as disclosed within FIG. 5, will now be RELEASED and permitted to drop downwardly so as to be RETAINED at the DISCHARGE position as illustrated in FIG. 7 in preparation for its release into the delivery chute section 124 when the pneumatic signals are again effectively reversed. It can be readily appreciated that this operative cycle can be accordingly repeated so as to place the necessary plurality of traffic cones 116 upon the roadway surface 118. It is noted further that the program logic controller (PLC) 240 is used not only to control the routing of the pneumatic signalling, but in addition, a predetermined control program can be integrated into the program logic controller (PLC) 240 such that the pneumatic signalling occurs at predetermined times. In this manner, the traffic cones 116 are released at predeterminedly timed intervals so as to effectively place the traffic cones 116 upon the roadway surface at locations which are spaced apart by means of predetermined distances.

Thus, it may be seen that in accordance with the principles and teachings of the present invention, new and improved manual and automatic systems or apparatus have been developed and disclosed for depositing traffic cones onto a roadway surface whereby such deposition process can in fact be achieved by operator or workman personnel in a relatively non-fatiguing manner, and more importantly, the operator or workman personnel are located at a safe work station upon the roadway service truck or vehicle such that the operator or workman personnel are not unnecessarily exposed to the dangers of oncoming or surrounding vehicular traffic as is characteristic of the PRIOR ART traffic cone deposition techniques.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. Apparatus for enabling traffic cones to be deposited onto a roadway surface by operator personnel located upon a roadwork vehicle, comprising:

a framework adapted to be secured to the roadwork vehicle so as to be movable with the roadwork vehicle as the roadwork vehicle moves along the roadway surface;

a magazine section defined upon said framework for accommodating a plurality of traffic cones to be dispensed and deposited onto the roadway surface, said magazine section adapted to extend horizontally across the roadwork vehicle so as to effectively define an operator work station located interiorly of the sides of the roadwork vehicle; and a vertically oriented chute section defined upon said framework and having a vertically upper end portion within which traffic cones, to be deposited upon the roadway surface, can be inserted, and a vertically lower end portion from which the traffic cones can be discharged so as to be deposited upon the roadway surface as the roadwork vehicle moves along the roadway surface.

2. The apparatus as set forth in claim 1, wherein:

said vertically oriented chute section has a substantially arcuate configuration.

3. The apparatus as set forth in claim 2, wherein:

said vertically oriented chute section comprises a pair of laterally spaced rail members each of which has a substantially arcuate configuration wherein vertically upper end portions of said rail members are disposed within a vertical plane, and vertically lower end portions of said rail members are disposed within a horizontal plane so as to be capable of depositing traffic cones upon the roadway surface in an upstanding state.

4. The apparatus as set forth in claim 3, wherein:

each one of said laterally spaced rail members has a channel defined therein for accommodating a base portion of each traffic cone whereby when the traffic cone is disposed within said vertically upper end portions of said rail members, the geometrical axis of the traffic cone will be disposed horizontally, whereas when the traffic cone is disposed within said vertically lower end portions of said rail members, the geometrical axis of the traffic cone will be disposed vertically.

5. The apparatus as set forth in claim 4, wherein:

said horizontally oriented magazine section is operatively connected to said vertically oriented chute section such that the plurality of traffic cones disposed within said magazine section are able to be serially fed into said vertically oriented chute section for deposition onto the roadway surface.

6. The apparatus as set forth in claim 5, further comprising:

a transition section defined upon said framework and operatively interconnecting said horizontally oriented magazine section to said vertically oriented chute section so as to permit traffic cones to be moved directly from said horizontally oriented magazine section into said vertically oriented chute section.

7. The apparatus as set forth in claim 5, further comprising:

a corner region defined upon said framework and operatively interconnecting said horizontally oriented magazine section to said vertically oriented chute section so as to permit traffic cones to be moved from said horizontally oriented magazine section into said corner region, and to permit traffic cones to be moved from said corner region into said vertically oriented chute section.

8. The apparatus as set forth in claim 7, further comprising:

means for automatically serially dispensing individual traffic cones from said corner region into said vertically oriented chute section so as to permit the traffic cones to be serially discharged from said vertically oriented chute section onto the roadway surface.

9. The apparatus as set forth in claim 8, wherein:

a first READY position is defined within said corner region of said framework for accommodating a first traffic cone to be subsequently dispensed into said vertically oriented chute section for discharge and deposition onto the roadway surface;

a second DISCHARGE position is defined within an upstream end portion of said vertically oriented chute section, and is located beneath said first READY position defined within said corner region of said framework, for accommodating the first traffic cone when the first traffic is released from said first READY position defined within said corner region of said framework so as to permit a second traffic cone to be moved into said first READY position defined within said corner region of said framework; and said means for automatically serially dispensing individual traffic cones from said corner region of said framework into said vertically oriented chute section, so as to permit the traffic cones to be serially discharged from said vertically oriented chute section and deposited onto the roadway surface, comprises first and second control mechanisms operatively disposed adjacent to said first READY and second DISCHARGE positions for retaining and releasing the first and second traffic cones at and from said first READY and second DISCHARGE positions at predetermined times in order to properly dispense the traffic cones into said vertically oriented chute section for discharge and deposition of the traffic cones onto the roadway surface.

10. The apparatus as set forth in claim 9, wherein:

said first and second control mechanisms are alternatively operable within oppositely effective RELEASE and RETAIN modes such that when said first control mechanism is disposed at its RELEASE position so as to release the first traffic cone from said READY position within said corner region of said framework, said second control mechanism is disposed at its RETAIN position so as to retain the first traffic cone, released from said READY position, at said DISCHARGE position, whereas when said first control mechanism is disposed at its RETAIN position so as to retain the second traffic cone at said READY position within said corner region of said framework, said second control mechanism is disposed at its RELEASE position so as to release the first traffic cone from said DISCHARGE position into said vertically oriented chute section for discharge and deposition onto the roadway surface.

11. The apparatus as set forth in claim 10, wherein:

said first and second control mechanisms comprise first and second dual-actuated pneumatically-controlled piston-cylinder assemblies; and first and second pneumatic control lines operatively connected to opposite ends of said first and second dual-actuated piston-cylinder assemblies so as to achieve said oppositely effective RELEASE and RETAIN modes.

12. The apparatus as set forth in claim 11, further comprising:

program logic control (PLC) means operatively connected to said first and second pneumatic control lines for controlling pneumatic signals to said first and second pneumatic control lines in a predeterminedly timed manner such that the traffic cones are discharged from said vertically-oriented chute section and deposited onto the roadway surface at predeterminedly spaced apart locations.

13. The apparatus set forth in claim 1, further comprising:

means for mounting said framework structure upon a side portion of the roadwork vehicle.

14. In combination, apparatus for enabling traffic cones to be deposited onto a roadway surface, comprising:

a roadwork vehicle upon which an operator can be stationed;

a framework adapted to be secured to said roadwork vehicle so as to be movable with said roadwork vehicle as said roadwork vehicle moves along the roadway surface;

a magazine section defined upon said framework for accommodating a plurality of traffic cones to be dispensed and deposited onto the roadway surface, said magazine section extending horizontally across said roadwork vehicle so as to effectively define an operator work station located interiorly of side portions of said roadwork vehicle; and a vertically oriented chute section defined upon said framework and having a vertically upper end portion within which traffic cones, to be deposited upon the roadway surface, can be inserted, and a vertically lower end portion from which the traffic cones can be discharged so as to be deposited upon the roadway surface as said roadwork vehicle moves along the roadway surface.

15. The combination as set forth in claim 14, wherein:

said vertically oriented chute section has a substantially arcuate configuration.

16. The combination as set forth in claim 15, wherein:

said vertically oriented chute section comprises a pair of laterally spaced rail members each of which has a substantially arcuate configuration wherein vertically upper end portions of said rail members are disposed within a vertical plane, and vertically lower end portions of said rail members are disposed within a horizontal plane so as to be capable of depositing traffic cones upon the roadway surface in an upstanding state.

17. The combination as set forth in claim 16, wherein:

each one of said laterally spaced rail members has a channel defined therein for accommodating a base portion of each traffic cone whereby when the traffic cone is disposed within said vertically upper end portions of said rail members, the geometrical axis of the traffic cone will be disposed horizontally, whereas when the traffic cone is disposed within said vertically lower end portions of said rail members, the geometrical axis of the traffic cone will be disposed vertically.

18. The combination as set forth in claim 14, further comprising:

a magazine section defined upon said framework for holding a plurality of traffic cones to be dispensed and deposited onto the roadway surface.

19. The combination as set forth in claim 18, further comprising:

a transition section defined upon said framework and operatively interconnecting said horizontally oriented magazine section to said vertically oriented chute section so as to permit traffic cones to be moved directly from said horizontally oriented magazine section into said vertically oriented chute section.

20. The combination as set forth in claim 18, further comprising:

a corner region defined upon said framework and operatively interconnecting said horizontally oriented magazine section to said vertically oriented chute section so as to permit traffic cones to be moved from said horizontally oriented magazine section into said corner region, and to permit traffic cones to be moved from said corner region into said vertically oriented chute section.

21. The combination as set forth in claim 20, further comprising:

means for automatically serially dispensing individual traffic cones from said corner region of said framework into said vertically oriented chute section so as to permit the traffic cones to be serially discharged from said vertically oriented chute section onto the roadway surface.

22. The combination as set forth in claim 21, wherein:

a first READY position is defined within said corner region of said framework for accommodating a first traffic cone to be subsequently dispensed into said vertically oriented chute section for discharge and deposition onto the roadway surface;

a second DISCHARGE position is defined within an upstream end portion of said vertically oriented chute section, and is located beneath said first READY position defined within said corner region of said framework, for accommodating the first traffic cone when the first traffic is released from said first READY position defined within said corner region of said framework so as to permit a second traffic cone to be moved into said first READY position defined within said corner region of said framework; and said means for automatically serially dispensing individual traffic cones from said corner region of said framework into said vertically oriented chute section, so as to permit the traffic cones to be serially discharged from said vertically oriented chute section and deposited onto the roadway surface, comprises first and second control mechanisms operatively disposed adjacent to said first READY and second DISCHARGE positions for retaining and releasing the first and second traffic cones at and from said first READY and second DISCHARGE positions at predetermined times in order to properly dispense the traffic cones into said vertically oriented chute section for discharge and deposition of the traffic cones onto the roadway surface.

23. The combination as set forth in claim 22, wherein:

said first and second control mechanisms are alternatively operable within oppositely effective RELEASE and RETAIN modes such that when said first control mechanism is disposed at its RELEASE position so as to release the first traffic cone from said READY position within said corner region of said framework, said second control mechanism is disposed at its RETAIN position so as to retain the first traffic cone, released from said READY position, at said DISCHARGE position, whereas when said first control mechanism is disposed at its RETAIN position so as to retain the second traffic cone at said READY position within said corner region of said framework, said second control mechanism is disposed at its RELEASE position so as to release the first traffic cone from said DISCHARGE position into said vertically oriented chute section for discharge and deposition onto the roadway surface.

24. The combination as set forth in claim 23, wherein:

said first and second control mechanisms comprise first and second dual-actuated pneumatically-controlled piston-cylinder assemblies; and first and second pneumatic control lines operatively connected to opposite ends of said first and second dual-actuated piston-cylinder assemblies so as to achieve said oppositely effective RELEASE and RETAIN modes.

25. The combination as set forth in claim 24, further comprising:

program logic control (PLC) means operatively connected to said first and second pneumatic control lines for controlling pneumatic signals to said first and second pneumatic control lines in a predeterminedly timed manner such that the traffic cones are discharged from said vertically-oriented chute section and deposited onto the roadway surface at predeterminedly spaced apart locations.

26. The combination as set forth in claim 17, further comprising:

said roadwork vehicle comprises a bed portion; and means for mounting said framework structure upon a side portion of said roadwork vehicle such that said horizontally oriented magazine overlies said bed portion of said roadwork vehicle.

* * * * *